United States Patent [19]

Michel

[11] 4,359,082

[45] Nov. 16, 1982

[54] METHOD AND APPARATUS FOR HARDENING MOLD PARTS MADE OF SAND FOR MAKING METAL CASTINGS

[76] Inventor: Horst-Werner Michel, Jahnstrasse 25, D-7707 Engen, Fed. Rep. of Germany

[21] Appl. No.: 155,526

[22] Filed: Jun. 2, 1980

Related U.S. Application Data

[63] Continuation of Ser. No. 928,901, Jul. 28, 1979, abandoned.

[51] Int. Cl.[3] ..... B22C 9/12

[52] U.S. Cl. ..... 164/16

[58] Field of Search ..... 164/12, 16, 154, 159

[56] References Cited

U.S. PATENT DOCUMENTS

| | | | |
|---|---|---|---|
| 4,064,926 | 12/1977 | Naegele | 164/12 X |
| 4,105,725 | 8/1978 | Ross | 164/16 X |
| 4,132,260 | 1/1979 | Lüber | 164/16 |

FOREIGN PATENT DOCUMENTS

| | | | |
|---|---|---|---|
| 2413537 | 10/1975 | Fed. Rep. of Germany | 164/16 |
| 48-25292 | 7/1973 | Japan | 164/16 |
| 1269202 | 4/1972 | United Kingdom | 164/16 |

*Primary Examiner*—Gus T. Hampilos

*Attorney, Agent, or Firm*—Price, Heneveld, Huizenga & Cooper

[57] ABSTRACT

An account is given of a method and apparatus for hardening mold parts, such as mold outer parts or mold cores for making metal castings, by using compressed air for forcing catalyst through the sand of the mold parts for reaction with a binding agent mixed with the sand.

7 Claims, 2 Drawing Figures

METHOD AND APPARATUS FOR HARDENING MOLD PARTS MADE OF SAND FOR MAKING METAL CASTINGS

This is a continuation of application Ser. No. 928,901, filed July 28, 1979, now abandoned.

BACKGROUND OF THE INVENTION

1. Field of the Invention

The present invention has to do with a method for hardening mold parts, that is to say mold cores and hollow mold parts, made of sand with the addition of a binding agent or binding agents able to be hardened by a catalyst, and used for making metal castings.

2. Prior Art

In this respect the starting point of the invention is a method, whose development I was responsible for, in the case of which a certain amount of a liquid catalyst is put in the mold part with the help of compressed air, with which the catalyst is mixed, and then the mold part is cleared or rinsed with catalyst-free compressed air.

It is important to make certain that there is an even distribution of the mist, produced by mixing catalyst and compressed air, throughout the mold parts, without drops of catalyst being retained on only some of the grains of sand and not transported fully into the remote portions, that is to say all portions of the mold part. For this purpose I made a suggestion of using a heating system for heating the mist evenly before leaving the mixing zone so that the catalyst is changed into a gas. For this reason it is a compressed air-catalyst gas mixture which goes into the mold part. This is something which promotes a quicker movement of the catalyst through the mold part material and, for this reason, a quicker hardening of the mold parts.

However, in comparison, such a manner of operation requires a great amount of energy, because the mist has to be heated up, generally speaking, from the temperature of the compressed air, which is generally between 0° and 20° C., to the temperature for changing the catalyst into its gaseous form, this being necessary every time the mist is forced through to the mold parts.

The starting temperature is normally towards the lower end of the given temperature range, because the compressed air is caused to give up moisture by forcing it through refrigeration dryers. If it is to be heated, it is naturally necessary for heat to be used for the compressed air in this respect. Furthermore, in this method the heating only takes place during a short time interval in the working step in question so that it is not possible to make certain that in fact there is a complete change of the catalyst into the gas form.

Objectives

One purpose of the invention is that of making certain the catalyst completely changes into its gaseous form and accomplishes this with very much smaller amounts of energy.

For effecting this and other purposes in the invention, the compressed air is heated in a normal way for the working run and the liquid catalyst is changed into its gaseous form in a shut-off chamber during the time interval between the working runs in the expanded but still hot air remaining from that which had been used for clearing.

So, in the invention the time interval between the working runs is used for changing the catalyst into its gaseous form and, because of the repeated motion of hot compressed air through the gas-producing and/or mixing zone, the zone is kept unchangingly at an increased temperature level so that it is no longer necessary for heating to take place from low temperatures to the gas-producing temperature, this resulting in the use of less energy.

The use of heated compressed air for the hardening of such cores or molds, that is to say mold parts, forms part of a suggestion for example as disclosed in the German specification (Auslegeschrift ) 2,546,032. However in that case use is not made of liquid catalyst and in fact the catalyst together with the heated compressed air in the form of a supporting gas-catalyst mixture is put into contact with the material to be conditioned. This old method, however, has the shortcoming that the amount of catalyst is measured by fixing the opening times of the valves and, furthermore, is dependent on the presure and temperature. In the method of my present invention, on the other hand, the catalyst may be put in very exact amounts using a measuring or metering pump. In order in the old method to have, even roughly, a sufficient amount of catalyst it was necessary to make use of catalyst in amounts which were in fact greater than needed, because it was only possible by this means to make certain that the minimum amount of catalyst necessary did in fact make its way into the mold part every time. However the amounts which were more than the amount in fact needed were released into the outside air, affecting this air.

An apparatus for using the method of the invention may have a pressure line joined with a mixing chamber, an outlet line joined with the mixing chamber for the liquid catalyst, a heating system and control valves, for controlling the admission of compressed air and of the catalyst to the mixing chamber in step with the working runs, characterised in that the heating system is joined with the inlet of the mixing chamber and between the mixing chamber and the mold part, that is to say the core or outer mold part, there is a further shutoff valve.

The result is that the whole zone between the shutoff valve or the inlet of compressed air to the mixing chamber and a shutoff valve between the mixing chamber and the core mold part may be used as an evaporation chamber for the liquid catalyst, and this evaporation chamber is kept all the time at a temperature which makes evaporation possible and relatively higher temperatures may be used during the time intervals between the separate working steps for substitute evaporation. The heating system in the form of a heating chamber may, in this respect be made greater in size, by using insert blocks so that a generally larger heat reserve is available for the gas-forming operation. Because, in this zone, heating no longer has to take place from the compressed air temperature to the gas-forming temperature, the energy demand is dependent only on the energy needed for keeping the heat reserve at the desired working temperature in question. To prevent heat going from this evaporation zone to the volumetric displacement pump and, for preventing the changing of the catalyst into its gaseous form on its way into this gas-forming zone, it is best, although not completely necessary, to provide cooling between the pump and the gas-forming zone. As far as possible, this should be done immediately adjacent the gas-forming zone. This cooling may be effected by a pipe system through which the cool or cold compressed air is forced.

DETAILED ACCOUNT OF INVENTION

Figure 1:
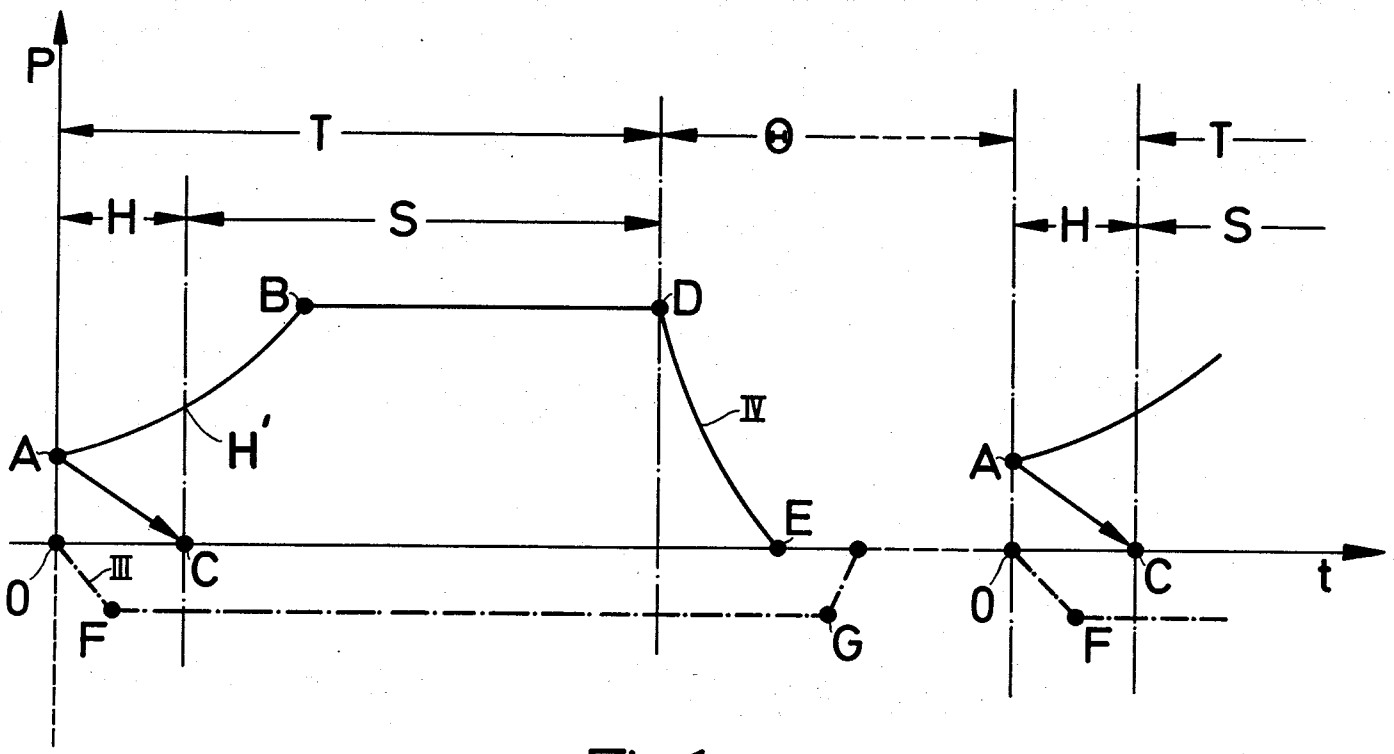
FIG. 1 is a diagrammatic representation of the operating cycle of the method of the invention.

In the diagram of FIG. 1 the horizontal axis represents time t, while the vertical axis represents pressure P.

At the zero point the working run or operating cycle is started. It has a working step or phase T and a rest step or phase $\theta$. The top curve or line is representative of the pressure behavior of the inlet compressed air. Below it, the decrease in the quantity of the catalyst in gaseous form in the working step is arrow, while the lowermost curve is representative of the takeup of the catalsyt and the introduction of the catalyst.

At the time zero, that is to say O, the inlet compressed air has a pressure value A of, for example, 2 bar, which is controlled by a valve system to be detailed later. In the working step the pressure may undergo an increase of for, example, up to 6 bar, a value which is attained at B. At the time O at the pressure A there is exists catalyst in gaseous form in the mixing zone, which zone is made up of the heating system and the mixing chamber. This catalyst is forced out during time H by the admission of compressed air and is reduced to an amount equal to zero at the point C. Starting at the point C in time, the hardening is stopped at point H′ and the clearing cycle is started in the clearing time S, which is terminated at the point D in time. At this point in time, the system is shut off from the compressed air inlet or line so that the pressure of the compressed air may be expended completely and finally the pressure will be at a normal value at E the same as the outside pressure. So the time T of a working step or phase comes to an end and the rest step $\theta$ is started.

Furthermore at the time O the takeup pump for the liquid catalyst will have been started and it continues working till the point F. As is to be seen, the position of this point F is dependent on the amount of catalyst to be used. On getting to the point F the pump is stopped, something which is made clear by the broken-line curve running parallel to the time axis. This curve extends past the time point E as far as the point G in time and after this time point the pump will be forcing the liquid catalyst into the part of the apparatus made up of the heating system and the mixing chamber, as is made clear by the curve extending as far as the point H in time. For this reason the complete working step will have been ended and it will be started again after the rest step or phase $\theta$ at another starting point O. The working run is, for this reason, made up of the working step of time T and the rest step of time $\theta$, it being specially important to the invention that the rest time $\theta$ is used for the forcing in of the liquid catalyst and, at the same time, evaporation of the liquid catalyst, which is on hand in its vapor or gaseous condition by the start of the next working step time T. It is naturally necessary for the rest time, in cases in which, for example, the apparatus is not used overnight, to be bridged over by turning on the heating even before the start of the next working step time T in order, at the start of the working step time, to have on hand catalyst in its vapor or gaseous form. However this starting up does not cause any change in the general operation or theory of the apparatus, that is to say, the compressed air released into the mixing chamber will have available a vapor or gaseous catalyst for transport into the core and into the outer mold part.

Figure 2:
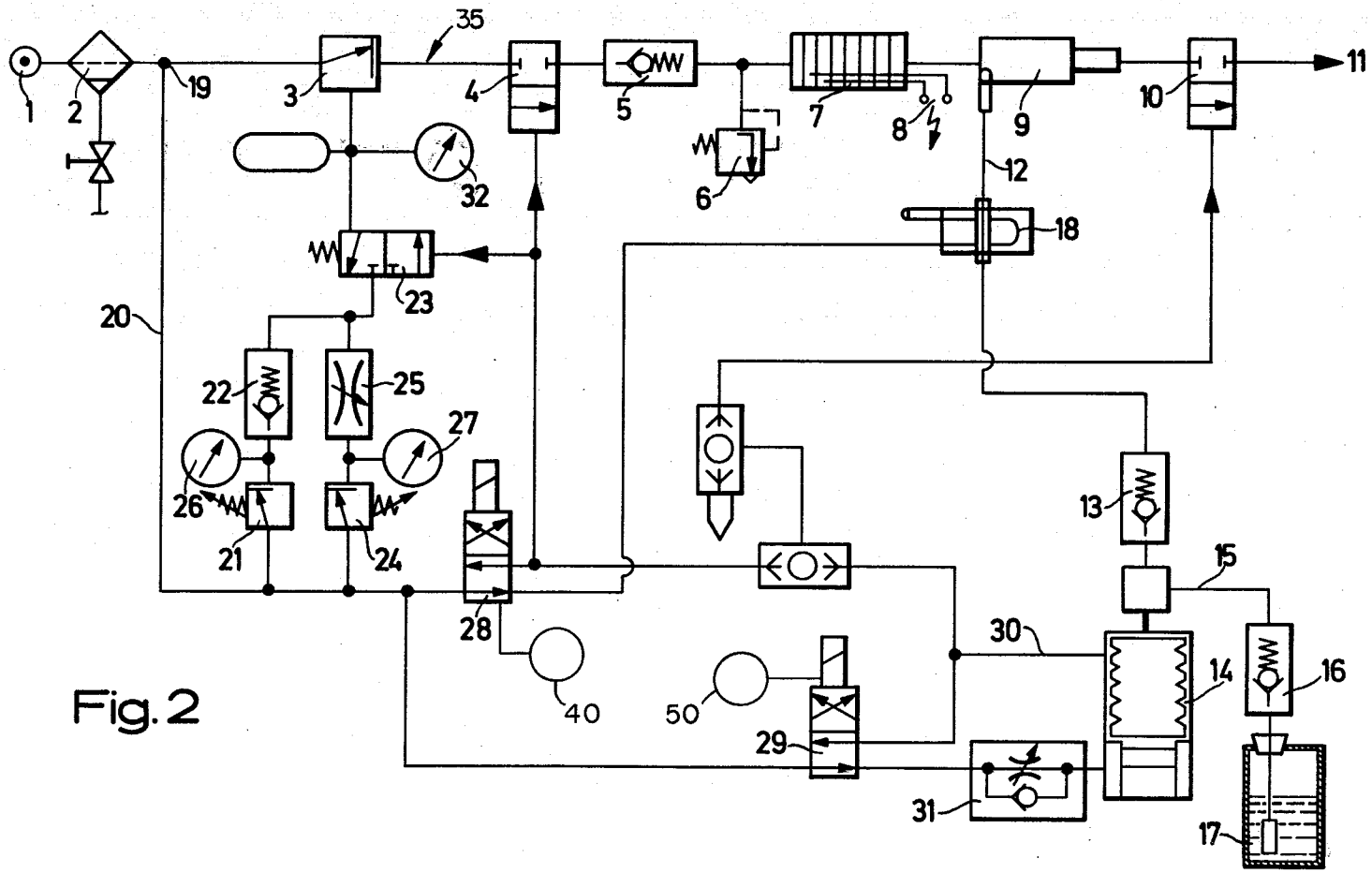
FIG. 2 is an equipment and flow diagram of the invention.

In the apparatus to be seen in FIG. 2 reference no. 1 identifies the connection with the compressed air line, which for example has a pressure of 6 bars. Reference no. 2 identifies a water, oil and dirt trap for making certain that the apparatus is only used with clean compressed air.

The incoming compressed air goes to the automatic control valve 3, which is operated by a part of the apparatus to be detailed later. From the automatic control valve 3 the compressed air goes to the shut off valve 4 by which it is possible for the unit, made up of the heating system and the mixing chamber, to be shut off or isolated from the compressed air line.

At 5 there is a safety check valve while reference number 6 identifies an overpressure valve acting as a safety valve of normal design and so needing no detailed account.

In a heating chamber 7, made more specially of aluminum, there is a duct made during casting of the chamber for the transport of compressed air through the chamber. Naturally it is possible to make use of any other heating system of the necessary design. Reference number 8 identifies the power connection, for example to electric power, for the heating chamber. From the heating chamber the compressed air goes into the mixing chamber 9 and from it through a shut off valve 10 in the direction of the arrow 11 to the core or outer mold part box. The air conduit from the compressed air source 1 to the shut off valve 10 forms an air passage 35.

In the mixing chamber there is the opening of a duct 12, which runs from a measuring pump 14. The duct 12 has a check valve 13 in it. The measuring (or metering) pump 14 obtains the liquid catalyst through the supply line 15 and a check valve 16 from the tank 17. The pump takes the liquid catalyst from the tank 17 forcing it, after shutting off the check valve 16, through the check valve 13 into the mixing chamber 9. In the duct 12 I have placed a cooling tube 18 for making certain that the heat from the heating system 7 and the mixing chamber 9 is not conducted by the duct to the pump 14, thus stopping any premature evaporation of liquid catalyst in this part. A portion of the compressed air coming from the line 1 is branched off at 19 through the duct 20 as control air. This control air goes through a pressure-decreasing valve 21 and a check valve 22 to an air-operated control valve 23. Also through a pressure-decreasing valve 24 and a control choke 25 the compressed air is supplied to the control valve 23. The pressures, fixed by adjustment, may be seen at once by reading the pressure gages 26 and 27. If a time control clock 40 is used for working the control valve 28, this control valve 28 will operate, on the one hand, the valve 4 and on the other hand of the valve 23 so that first air at the lower pressure, for example 2 bars, will be passed through the automatic control valve 3 and the valve 4 and the check valve 5 into the line going to the heating chamber 7. At the same time the valve 29 is operated, which makes possible the movement of air through the duct 30 to the measuring pump 14 so that the pump's piston is moved downwards and the necessary amount, fixed by adjustment, to withdraw liquid catalyst from the tank 17 into the pump. This operation is illustrated in FIG. 1 as the drop in the catalyst curve III between the points O and F. The speed of take-up may undergo adjustment with the help of a choke valve 31. At the same time as the operation of the valves 28 and 29, the valves 4 and 10 are opened by way of the lines used for this purpose. Because, in the unit made up of the heating chamber and the mixing chamber the necessary mixture of air and catalyst in gaseous form is present from the preceding working step, this mixture is now forced by the compressed air, coming from the compressed air line, through the open valves to the core box. When this is done the valve 3 is smoothly opened further because the control valve 24, which has been set at a higher pressure value, will be operating the valve 3 more and more, through the valves 25 and 23, until a certain pressure value is produced, as is the case at point B in FIG. 1.

This point is attained after the whole of the catalyst in gaseous form has been forced into the core on reaching the point C, and then the clearing time is started as well. At the end of the clearing time, that is to say on reaching point D in the graph of FIG. 1, the valve 28 is switched off by the clock 40 so that the valve 4 is shut. The valve 10 is kept open by the valve 29, which is controlled by a second clock 50, but up to this point has not been operated. The pressure of the compressed air is for this reason able to undergo a decrease from point D to point E along the curve IV. It is only at point G that the valve 29 has the added effect of shutting the valve 10 so that there is now available an isolated portion of the apparatus, into which from the point G to the point H the quantity of liquid catalyst, taken up in the pump 14 from the tank 17, is forced into the space made up of the heating chamber 7 and the mixing chamber 9. In this space there is heated, unexpanded compressed air, which because of the amount of heat in it, is responsible for changing the catalyst into its gaseous form at once. This gaseous form catalyst is kept in the portion of the apparatus between the valves 5 and 10 and is on hand for the next working operation, which if necessary, after a long resting time, will take place in quite the same way as detailed.

It is furthermore pointed out that it is possible, by reading the pressure gage 32, to take note of the complete development of pressure of the compressed air as made clear by the curve for the compressed air of FIG. 1. It is for this reason possible to make a change in the form of the curves, as may be desired, by making a further adjustment of the choke 25, and keeping an eye on the changes in the position of the hand of the pressure gage 32.

I claim:

1. A method for hardening mold parts to be used for making metal castings which parts are made from a mixture of sand and a binding agent capable of being catalyst hardened, the method characterized by an operating cycle having a rest phase and a working phase including the steps of providing a source of compressed air, providing a passage connecting said source to the mold part, during said rest phase filling said passage with air at one pressure, isolating a portion of the passage from both the compressed air source and the mold part with air at the one atmospheric pressure trapped therein, introducing under pressure in liquid phase a predetermined quantity of a vaporizable catalyst into said portion, heating the catalyst while isolated in said portion to the vaporization temperature of the catalyst and vaporizing all the catalyst to form an air/catalyst mixture; during said working phase opening said portion to the mold part and said compressed air source to said portion and releasing a quantity of catalyst-free compressed air into and through said portion at a pressure higher than that of the air/catalyst mix in said passage to force the air/catalyst mix as a charge into the mold part and thereafter passing an additional quantity of the catalyst-free compressed air through said portion and the mold part to clear both of residual catalyst, terminating the flow of compressed air through said passage and reinstating said rest phase.

2. The method for hardening mold parts described in claim 1 further characterized in that said steps of opening said portion to the mold part and releasing compressed air to flow through said portion are performed simultaneously.

3. The method for hardening mold parts described in claim 1 further characterized in that said heating is continuous both when said passage is opened to said compressed air source and mold part and when it is isolated therefrom.

4. A method for hardening mold parts to be used for making metal castings which parts are made from a mixture of sand and a binding agent capable of being catalyst hardened, the method characterized by the steps of providing a source of compressed air, providing a passage connecting said source to the mold part, intermittently releasing compressed air from said compressed air source through said passage in pulses; causing a time interval to occur between each of said releases; isolating at least a portion of said passage from both said compressed air source and the mold part during each such interval and trapping air therein at a pressure less than that of said compressed air source; while said portion of said passage is isolated injecting in liquid phase a predetermined quantity of a vaporizable catalyst into said portion of said passage and mixing it with the air trapped in said passage and heating said catalyst in said passage to a temperature sufficient to vaporize all of the catalyst and form an air/catalyst gaseous mixture prior to the termination of the interval in which the passage is isolated, simultaneously opening said passasge to the mold part and compressed air source and passing a quantity of compressed air through said passage to force all the air/catalyst mix as a charge ahead of it into the mold part.

5. The method of hardening mold parts described in claim 4 further characterized by applying said heat continuously.

6. The method of hardening mold parts described in claim 8 further characterized in that said portion of said passage is elongated and said heat is applied in said portion upstream of the point of catalyst injection with respect to the direction of flow of the air therethrough.

7. The method of hardening mold parts described in either claims 5 or 6 further characterized in that the catalyst is metered into separate charges of a predetermined volume before introduction and each charge is injected into the passage under pressure immediately after the passage has been isolated.

* * * * *

UNITED STATES PATENT AND TRADEMARK OFFICE

CERTIFICATE OF CORRECTION

PATENT NO. : 4 359 082

DATED : November 16, 1982

INVENTOR(S) : Horst-Werner Michel

It is certified that error appears in the above-identified patent and that said Letters Patent is hereby corrected as shown below:

Column 2, line 50:

"substitute" should be --effecting--

Column 3, line 17:

Before "arrow" insert --represented by an--

Column 6, Claim 6, line 54:

"8" should be --5--

Signed and Sealed this

Twenty-second Day of March 1983

[SEAL]

*Attest:*

GERALD J. MOSSINGHOFF

*Attesting Officer*

*Commissioner of Patents and Trademarks*